US005934984A

United States Patent [19]

Togawa et al.

[11] Patent Number: 5,934,984

[45] **Date of Patent: *Aug. 10, 1999**

[54] POLISHING APPARATUS

[75] Inventors: Tetsuji Togawa, Chigasaki; Shunichiro Kojima, Fujisawa, both of Japan

[73] Assignee: Ebara Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/806,622

[22] Filed: Feb. 26, 1997

[30] Foreign Application Priority Data

Feb. 26, 1996 [JP] Japan ..... 8-065435

[51] Int. Cl.[6] ..... B24B 13/05

[52] U.S. Cl. ..... 451/288; 451/41; 451/286; 451/289; 451/287; 414/749; 414/936

[58] Field of Search ..... 451/285–290, 451/41, 413; 206/710, 724; 414/750, 749, 936

[56] References Cited

U.S. PATENT DOCUMENTS

| | | | |
|---|---|---|---|
| 4,211,512 | 7/1980 | Zanki | 451/413 |
| 4,583,909 | 4/1986 | Yamashita et al. | 414/749 |
| 4,944,119 | 7/1990 | Gill, Jr. et al. . | |
| 5,476,414 | 12/1995 | Hirose et al. . | |
| 5,498,199 | 3/1996 | Karlrud et al. | 451/289 |
| 5,612,603 | 3/1997 | Kim | 414/749 |
| 5,616,063 | 4/1997 | Okumura et al. | 451/285 |
| 5,620,357 | 4/1997 | Mikasa et al. | 451/288 |
| 5,655,954 | 8/1997 | Oishi et al. | 451/288 |
| 5,738,574 | 4/1998 | Tolles et al. . | |

FOREIGN PATENT DOCUMENTS 63-207559 8/1988 Japan .

*Primary Examiner*—Robert A. Rose
*Assistant Examiner*—George Nguyen
*Attorney, Agent, or Firm*—Wenderoth, Lind & Ponack, L.L.P.

[57] ABSTRACT

A polishing apparatus is used for polishing a workpiece such as a semiconductor wafer to a flat mirror finish. The polishing apparatus has a pusher for transferring the workpiece between a top ring of a polishing apparatus and the pusher. The polishing apparatus includes a turntable having a polishing surface, a top ring for supporting the workpiece to be polished and pressing the workpiece against the polishing surface, and a pusher for transferring the workpiece between the top ring and the pusher. The pusher comprises a workpiece support for supporting the workpiece, an actuating unit for moving the workpiece support in a vertical direction, a sliding mechanism movable within a horizontal plane, and a positioning mechanism for positioning the workpiece support and the top ring with respect to each other in association with the sliding mechanism when the workpiece is transferred between the workpiece support and the top ring.

30 Claims, 7 Drawing Sheets

POLISHING APPARATUS

BACKGROUND OF THE INVENTION

1. Field of the Invention

The present invention relates to a polishing apparatus for polishing a workpiece such as a semiconductor wafer to a flat mirror finish, and more particularly to a polishing apparatus having a pusher for transferring a workpiece between a top ring of a polishing apparatus and a robot associated with the polishing apparatus.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated.

It has been customary to install a robot to transfer a semiconductor wafer therefrom to the top ring before it is polished, and to transfer the semiconductor wafer from the top ring thereto after it is polished. That is, the semiconductor wafer is transferred directly between the top ring and the hand of the robot which is associated with the polishing apparatus.

However, to transfer a semiconductor wafer directly between the top ring and the hand of the robot causes a conveyance error because the top ring and the robot usually have irregularities in conveying accuracy.

In order to improve the conveying accuracy of the top ring and the robot, it is preferable to install a pusher at a transfer position for the semiconductor wafer. In this case, the pusher has such a function as to place thereon a semiconductor wafer to be polished, which has been conveyed by the hand of the robot, and then to lift and transfer the semiconductor wafer onto the top ring which has been moved over the pusher. Further, the pusher has another function as to receive the semiconductor wafer which has been polished from the top ring, and then to transfer the semiconductor wafer onto the hand of the robot. Therefore, the pusher can smoothly transfer the semiconductor wafer between the top ring and the hand of the robot without a conveyance error.

The pusher, however, has to be positionally adjusted highly accurately with respect to both the top ring and the hand of the robot. Troublesome and time-consuming operations are required to set an accurate transfer position where the pusher is to be positioned.

SUMMARY OF THE INVENTION

It is therefore an object of the present invention to provide a polishing apparatus having a pusher which can improve transfer accuracy of a workpiece such as a semiconductor wafer.

According to one aspect of the present invention, there is provided a polishing apparatus for polishing a surface of a workpiece comprising: a turntable having a polishing surface; a top ring for supporting the workpiece to be polished and pressing the workpiece against the polishing surface; and a pusher for transferring the workpiece between the top ring and the pusher itself; the pusher comprising: a workpiece support for supporting the workpiece; an actuating unit for moving the workpiece support in a vertical direction; a sliding mechanism movable within a horizontal plane; and a first positioning mechanism for positioning the workpiece support and the top ring with respect to each other in association with the sliding mechanism when the workpiece is transferred between the workpiece support and the top ring.

The positioning mechanism may comprise at least one engaging member for engaging a predetermined portion of the top ring when the workpiece support is moved toward the top ring by the actuating unit. The engaging member may comprise a guide post which engages an outer circumferential surface of the top ring.

The workpiece support may have a workpiece holder having a plurality of guide pins for guiding the workpiece which is removed from the top ring toward a location provided on the workpiece holder. The sliding mechanism may be provided between the workpiece support and the actuating unit, and comprises a pair of sliding mechanisms disposed perpendicularly to each other and each having a rail and a slider movable along the rail.

According to another aspect of the present invention, there is provided a polishing apparatus for polishing a surface of a workpiece comprising: a turntable having a polishing surface; a top ring for supporting the workpiece to be polished and pressing the workpiece against said polishing surface; and a pusher for transferring the workpiece between said top ring and said pusher; said pusher comprising: a workpiece support for supporting the workpiece; an actuating unit for moving said workpiece support in a vertical direction; and a first positioning mechanism for positioning said workpiece support and said top ring with respect to each other when the workpiece is transferred between the workpiece support and the top ring.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

A polishing apparatus according to an embodiment of the present invention will be described below with reference to FIGS. 1 through 7.

Figure 1:
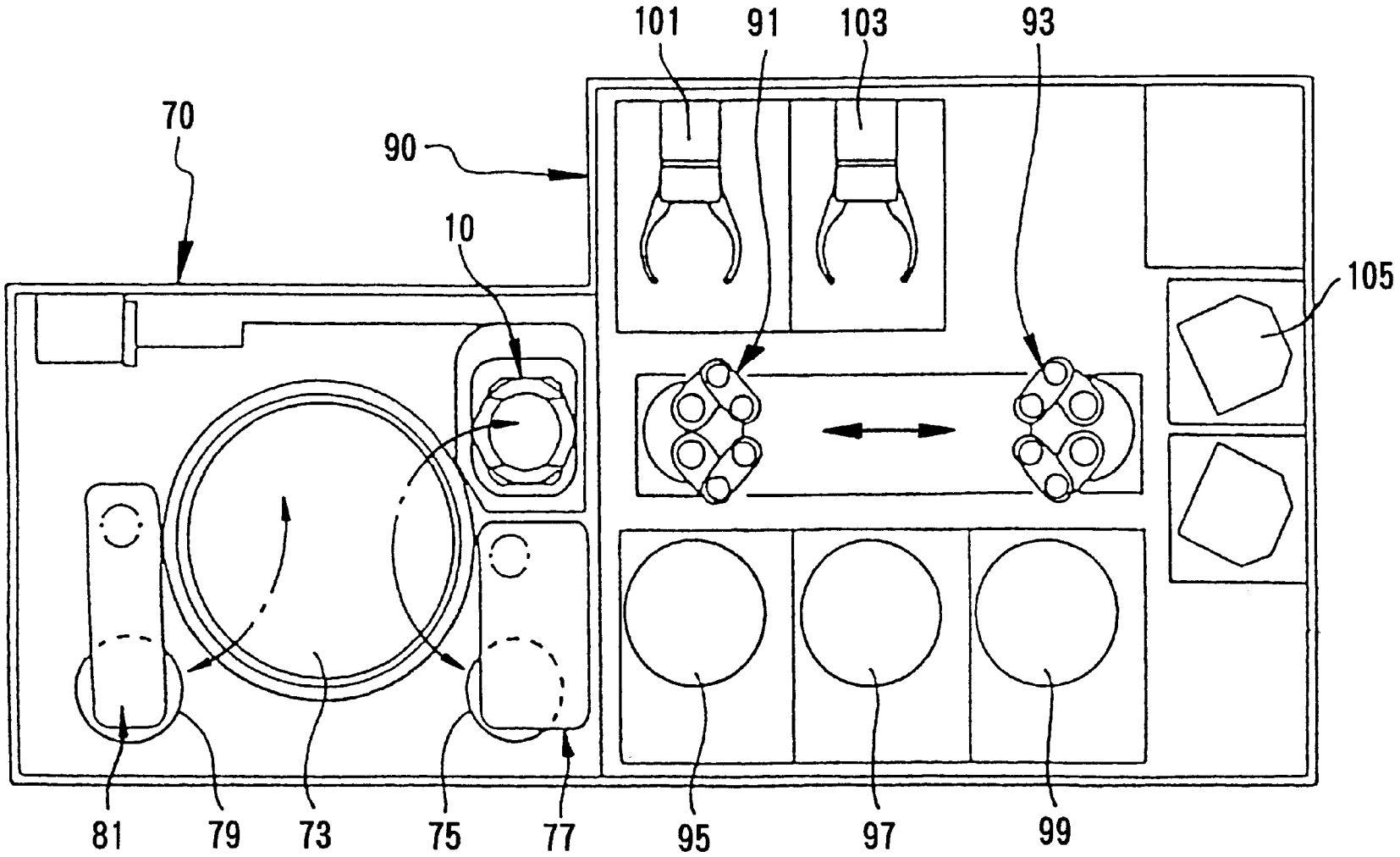
FIG. 1 is a plan view of a polishing apparatus which has a pusher, and a conveying and cleaning unit according to an embodiment of the present invention.

As shown in FIG. 1, a polishing apparatus 70 comprises a turntable 73, a polishing unit 77 positioned on one side of the turntable 73 and having a top ring 75, and a dressing unit 81 positioned on the other side of the turntable 73 and having a dressing tool 79. The polishing apparatus 70 has a pusher 10 disposed adjacent to the polishing unit 77 and the turntable 73.

The polishing apparatus 70 further comprises a conveying and cleaning unit 90 which is disposed next to the polishing unit 77 and the pusher 10. The conveying and cleaning unit 90 comprises two central workpiece conveying robots 91 and 93 movable in the directions indicated by the arrow F, primary and secondary cleaning devices 95 and 97, and a spinning drier 99 which are disposed on one side of the workpiece conveying robots 91 and 93. The conveying and cleaning unit 90 further comprises two workpiece reversing units 101 and 103 disposed on the other side of the workpiece conveying robots 91 and 93.

Figure 2:
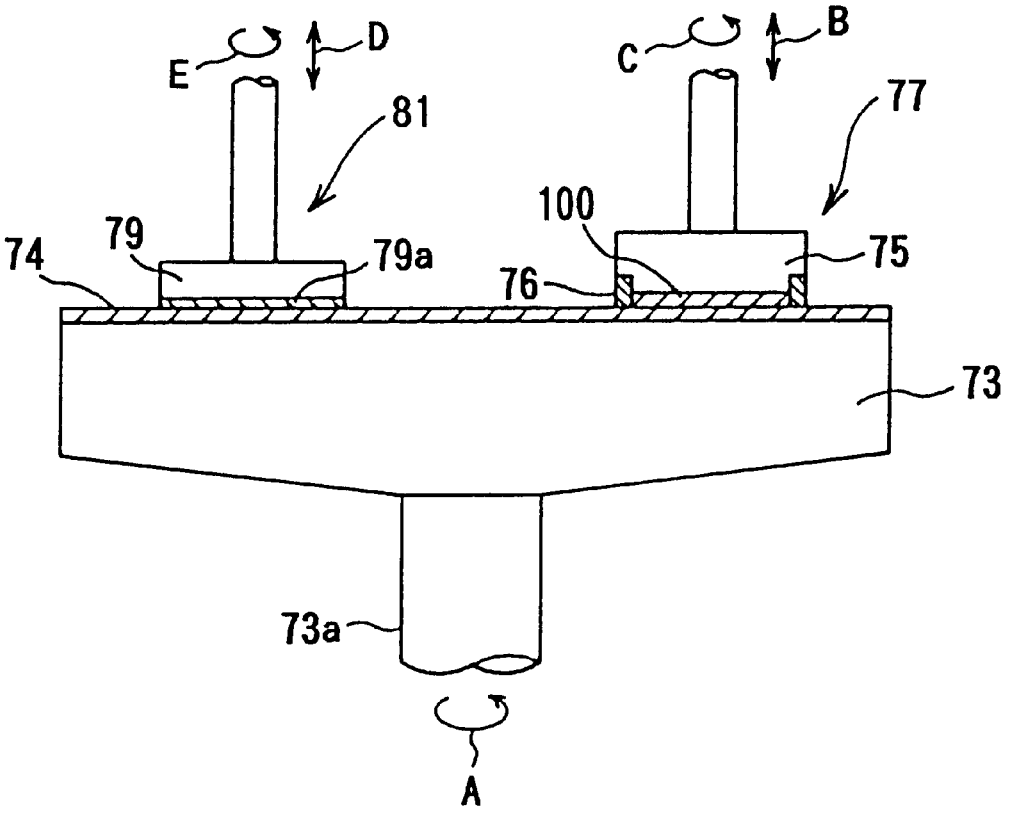
FIG. 2 is a vertical cross-sectional view of a polishing apparatus showing a polishing unit and a dressing unit according to an embodiment of the present invention.

FIG. 2 shows the polishing unit 77 having the top ring 75 and the dressing unit 81 having the dressing tool 79. As shown in FIG. 2, the top ring 75 is located in an off-center position with respect to the turntable 73. The turntable 73 is rotatable about its own axis as indicated by the arrow A by a motor (not shown) which is coupled through a shaft 73*a* to the turntable 73. A polishing cloth 74 is attached to an upper surface of the turntable 73.

The top ring 75 is coupled to a motor (not shown) and also to a lifting/lowering cylinder (not shown). The top ring 75 is vertically movable and rotatable about its own axis as indicated by the arrows B, C by the motor and the lifting/lowering cylinder. The top ring 75 can therefore press the semiconductor wafer 100 against the polishing cloth 74 under a desired pressure. The semiconductor wafer 100 is attached to a lower surface of the top ring 75 under a vacuum or the like. A guide ring 76 is mounted on the outer circumferential edge of the lower surface of the top ring 75 for preventing the semiconductor wafer 100 from being disengaged from the top ring 75.

A dressing unit 81 comprises a dressing tool 79 which is positioned above the turntable 73 in diametrically opposite relation to the top ring 75. The dressing tool 79 is coupled to a motor (not shown) and also to a lifting/lowering cylinder (not shown). The dressing tool 79 is vertically movable and rotatable about its own axis as indicated by the arrows D, E by the motor and the lifting/lowering cylinder. The dressing tool 79 has a dressing layer 79*a* composed of, for example, a diamond grain layer containing diamond grains on its lower surface.

When a wafer cassette 105 which houses a plurality of semiconductor wafers to be polished is set in a position shown in FIG. 1, the workpiece conveying robot 93 takes out a semiconductor wafer from the cassette 105, and transfers the semiconductor wafer to the workpiece reversing unit 103. After the semiconductor wafer is reversed, i.e., turned upside down, by the workpiece reversing unit 103, it is received by the workpiece conveying robot 91, and then placed onto the pusher 10 by the workpiece conveying robot 91.

Thereafter, the top ring 75 of the polishing unit 77 is angularly displaced as indicated by the dot-and-dash line to a position directly above the pusher 10. The semiconductor wafer on the pusher 10 is lifted to a position near a lower surface of the top ring 75, and then attached to the top ring 75 under vacuum developed by a vacuum pump or the like (not shown).

Then, the top ring 75 is moved over the turntable 73, and presses the semiconductor wafer against the polishing cloth 74 on the turntable 73. While the turntable 73 and the top ring 75 are rotated independently of each other, the lower surface of the semiconductor wafer is polished to a flat mirror finish. After the semiconductor wafer is polished, the top ring 75 is moved back over the pusher 10, and transfers the polished semiconductor wafer onto the pusher 10.

The semiconductor wafer placed on the pusher 10 is then held by the workpiece conveying robot 91, and transferred therefrom to the workpiece reversing unit 101. The workpiece reversing unit 101 reverses the semiconductor wafer. The reversed semiconductor wafer is transferred successively to the primary and secondary cleaning devices 95 and 97, and the spinning drier 99, whereby it is cleaned and dried. The spinning drier 99 may have a function of cleaning and drying. The cleaned and dried semiconductor wafer is finally returned to the cassette 105 by the workpiece conveying robot 93.

Figure 3:
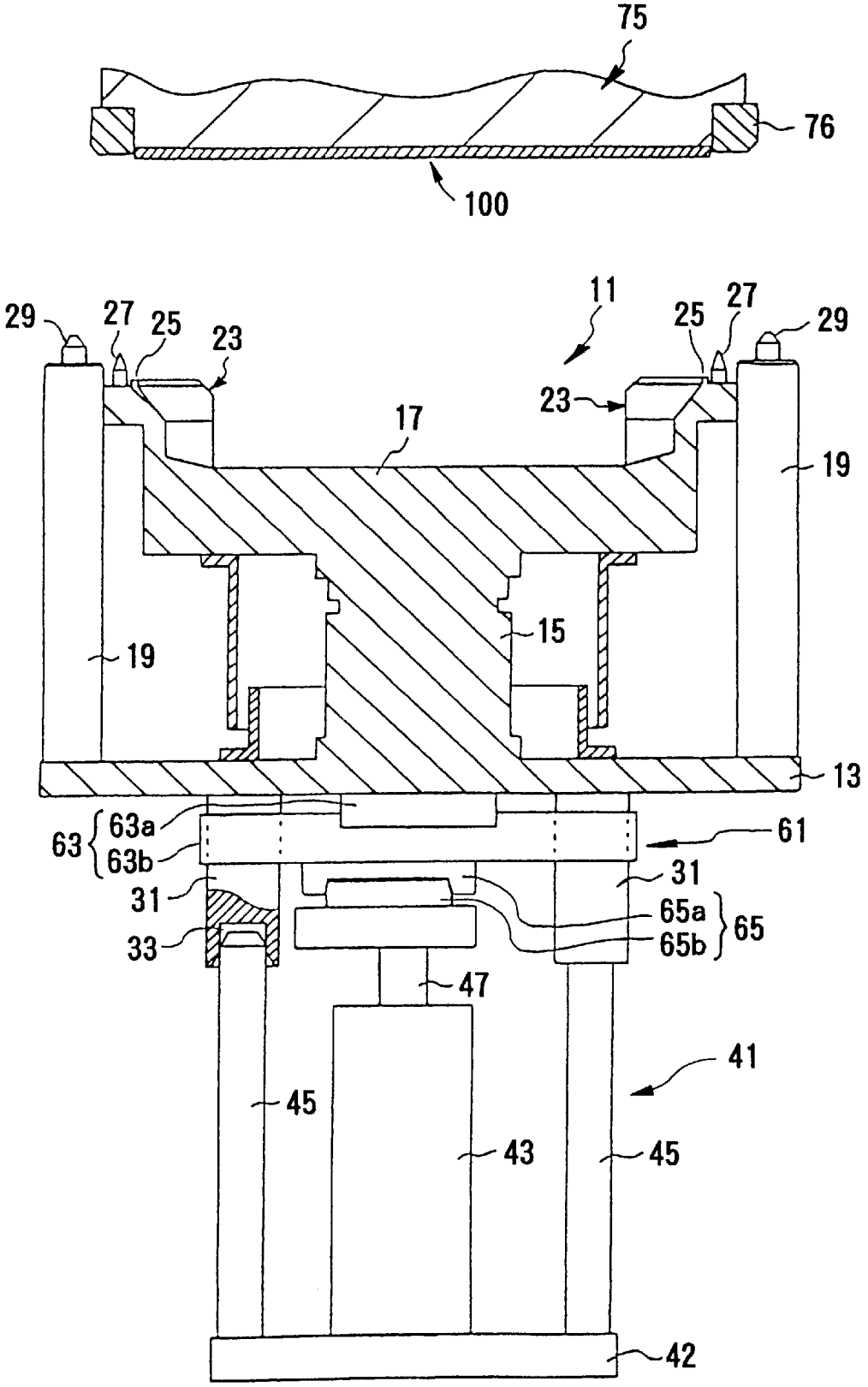
FIG. 3 is a vertical cross-sectional view of the pusher according to an embodiment of the present invention.

FIG. 3 shows the pusher 10 in vertical cross section at enlarged scale. As shown in FIG. 3, the pusher 10 comprises a workpiece support 11 for placing the semiconductor wafer 100 thereon, an actuating unit 41 for vertically moving the workpiece support 11, and a sliding mechanism 61 disposed between the workpiece support 11 and the actuating unit 41.

Figure 4:
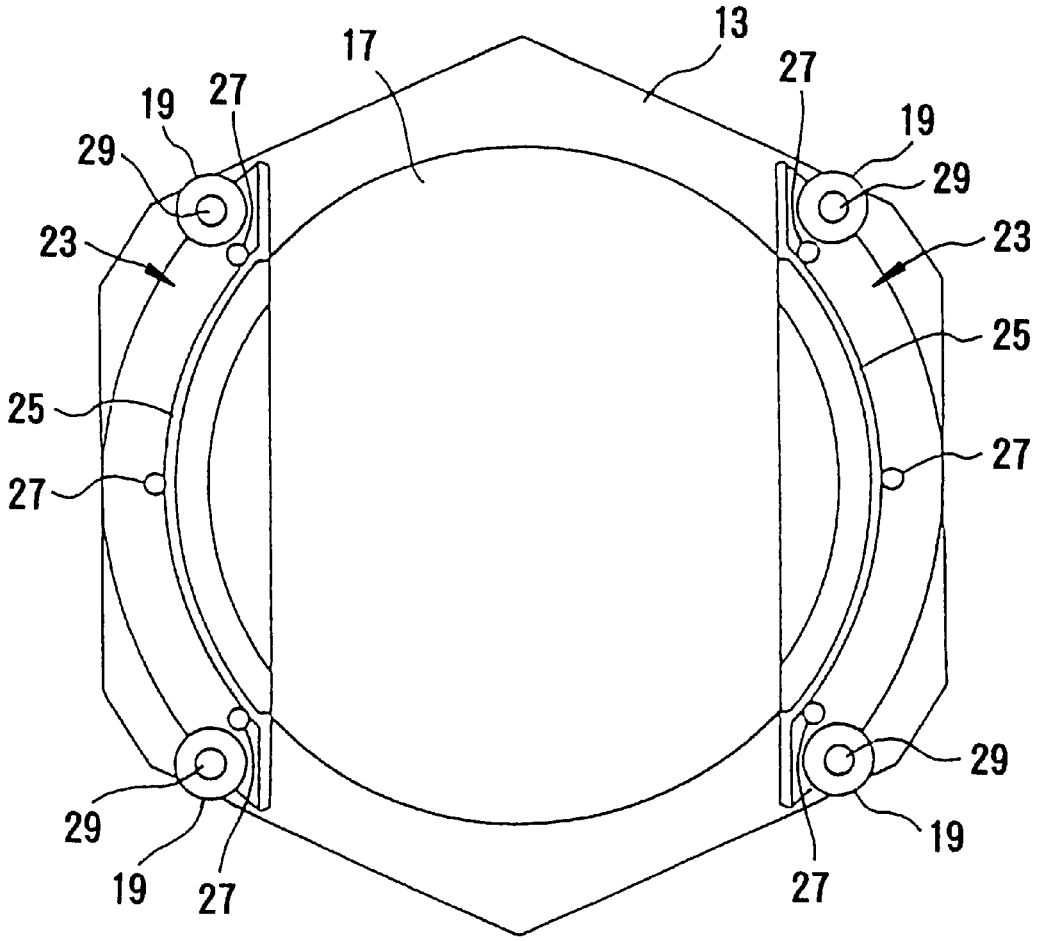
FIG. 4 is a plan view of the pusher shown in FIG. 3.

FIG. 4 is a plan view of the pusher 10 shown in FIG. 3. As shown in FIGS. 3 and 4, the workpiece support 11 has a substantially hexagonal base plate 13, a vertical support column 15 extending upwardly from the center of the base plate 13, and a substantially circular support table 17 provided on the upper end of the support column 15. The workpiece support 11 also has four vertical support pillars 19 spaced at equal distances and extending upwardly from outer edge areas of the base plate 13.

The support table 17 has a flat upper surface, and a pair of diametrically spaced wafer holders 23 disposed one on each side of the flat upper surface. The wafer holders 23 have respective arcuate ridges 25 projecting upwardly. Each of the wafer holders 23 has three upwardly extending, equally spaced guide pins 27 disposed radially outwardly of the arcuate ridge 25 for positioning the semiconductor wafer 100 on the arcuate ridge 25. Specifically, the central guide pin 27 is positioned adjacent to the center of the arcuate ridge 25, and the other guide pins 27 are positioned respectively adjacent to the ends of the arcuate ridge 25.

The arcuate ridges 25 are positioned relatively to each other such that they jointly form a part of a circle having a certain radius. The arcuate ridges 25 are of such dimensions as to contact the outer edge of the lower surface of the semiconductor wafer 100 when the semiconductor wafer 100 is placed thereon.

The guide pins 27 have a height higher than the arcuate ridges 25, and have respective upper ends formed into a conical shape. The guide pins 27 are vertically movable and normally are urged upwardly under the bias of resilient members; housed in the respective wafer holders 23.

The four vertical support pillars 19 have upper end portions projecting upwardly above the wafer holders 23, and have respective guide posts 29 projecting centrally from the respective upper ends of the support pillars 19. Each of the guide posts 29 has a conical tip end.

The guide posts 29 are disposed as a positioning mechanism for guiding and positioning an outer circumferential edge of the guide ring 76 which is mounted on an outer circumferential portion of the top ring 75, such that the outer circumferential edge of the guide ring 76 will be positioned radially inwardly of the guide posts 29. The guide posts 29 are made of a highly slippery or low friction material such as Teflon (trade mark; polytetrafluoroethylene), Daiflon (trade mark; polychlorotrifluoroethylene), or stainless steel which is polished to reduce frictional resistance, or material coated with the above slippery material, in order to prevent damage to the guide ring 76 by contact with the guide posts 29.

Figure 5:
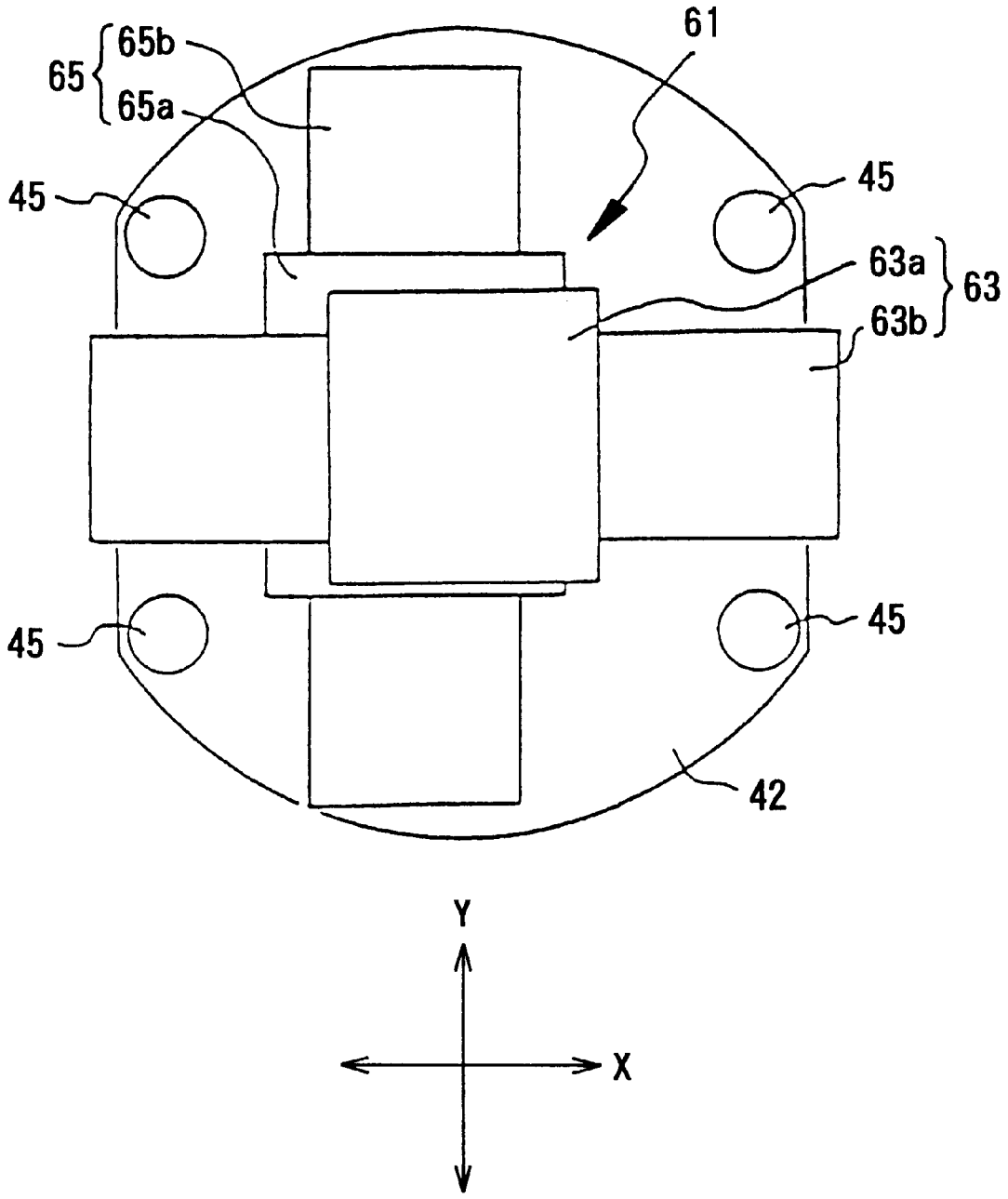
FIG. 5 is a plan view of components of the pusher which are positioned beneath a base plate thereof.

FIG. 5 shows components of the pusher 10 which are positioned beneath the base plate 13. As shown in FIGS. 3 and 5, the actuating unit 41 comprises a fixed base 42, a vertical actuating mechanism 43 mounted on the fixed base 42, and four positioning pillars 45 vertically mounted on the fixed base 42 around the vertical actuating mechanism 43. The actuating unit 41 may have a single positioning pillar rather then the four positioning pillars 45. The vertical actuating mechanism 43 has a vertical shaft 47 for vertically moving the workpiece support 11. The vertical actuating mechanism 43 may comprise a combination of a stepping motor and a ball screw, or a pneumatic cylinder, or a similar actuating assembly.

The sliding mechanism 61 is mounted on the upper end of the shaft 47 of the vertical actuating mechanism 43. As shown in FIGS. 3 and 5, the sliding mechanism 61 comprises upper and lower linear sliding assemblies 63 and 65 operatively provided between the base plate 13 and the shaft 47. Specifically, the upper linear sliding assembly 63 comprises a slider 63*a* fixed to a lower surface of the base plate 13, and a rail 63*b* extending in the horizontal direction indicated by the arrow X and supporting the slider 63*a* thereon for movement therealong in the horizontal direction indicated by the arrow X. The lower linear sliding assembly 65 comprises a slider 65*a* fixed to a lower surface of the rail 63*b*, and a rail 65*b* extending in the horizontal direction indicated by the arrow Y perpendicular to the arrow X and supporting the slider 65*a* thereon for movement therealong in the horizontal direction indicated by the arrow Y.

The sliding mechanism 61 allows the workpiece support 11 to slide freely in both the horizontal directions indicated by the arrows X, Y, i.e., in any direction within a horizontal plane which includes X- and Y-axes.

Four downwardly projecting legs 31 are mounted on the lower surface of the base plate 13 and have respective downwardly open tapered recesses 33 defined in the respective lower ends thereof. When the workpiece support 11 is lowered as shown in FIG. 3, the respective ends of the four positioning pillars 45 engage the respective recesses 33, thereby accurately positioning the workpiece support 11 with respect to the actuating unit 41.

Next, operation of the pusher 10 will be described below.

The semiconductor wafer 100 is attached centrally to the lower surface of the top ring 75 under vacuum while it is guided by the inner circumferential edge of the guide ring 76 fixed to the outer circumferential portion of the top ring 75.

When the semiconductor wafer 100 is transferred from the top ring 75 to the pusher 10, the top ring 75 is moved to the position directly above the pusher 10 as shown in FIG. 3. The guide ring 76 has at least its outer circumferential surface made of a hard material such as stainless steel or a synthetic resin comprising PVC (poly vinyl chloride) or polycarbonate so as not to be damaged when it is in contact with the guide posts 29.

Figure 6:
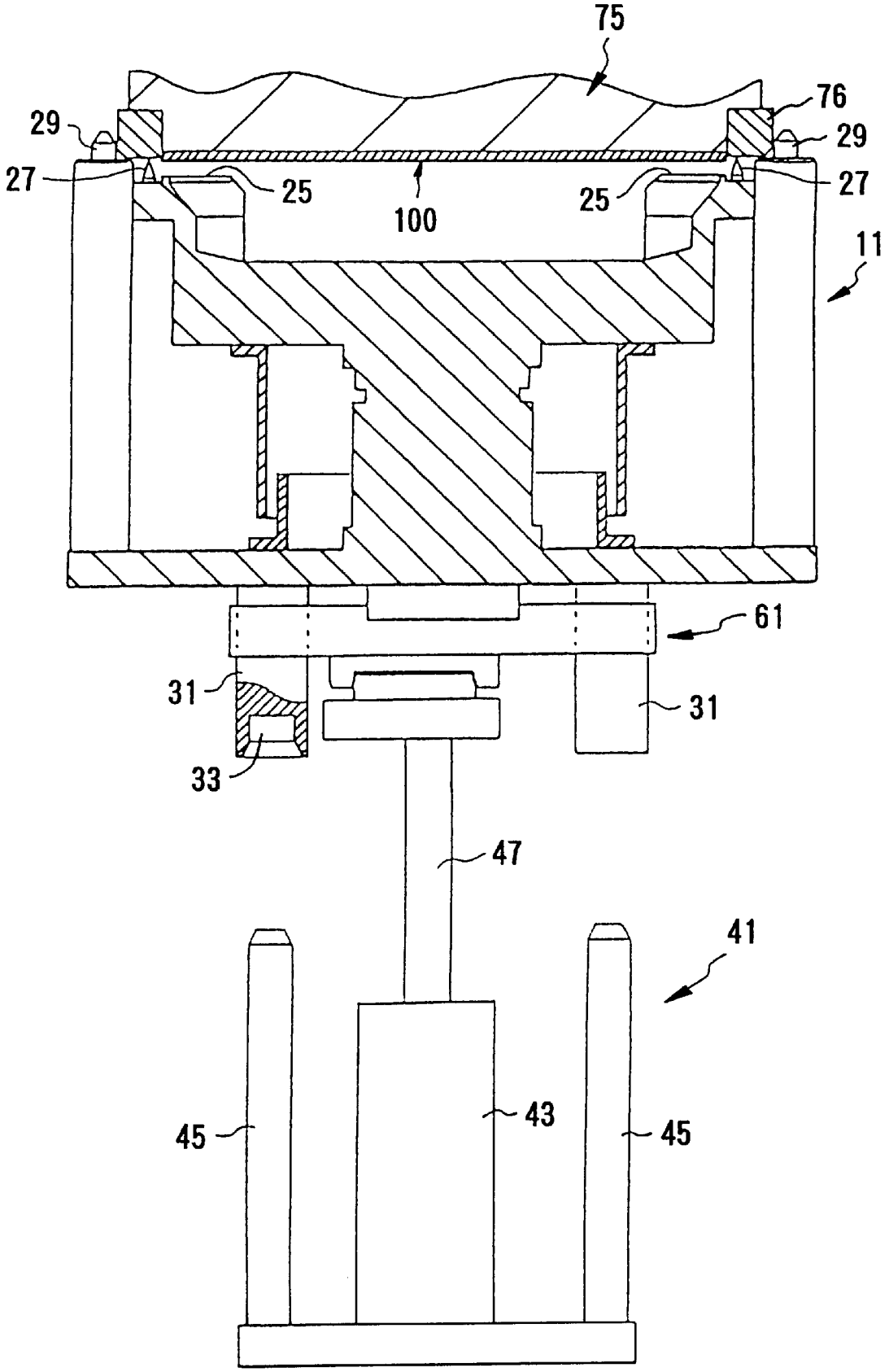
FIG. 6 is a vertical cross-sectional view of the pusher which is in operation according to an embodiment of the present invention.

Then, the vertical actuating mechanism 43 is operated to elevate the workpiece support 11, whereby the legs 31 are disengaged from the pillars 45 and the guide ring 76 mounted on the top ring 75 is positioned in the guide posts 29 while the guide ring 76 is guided by the guide posts 29, as shown in FIG. 6. Thus, the relative position between the workpiece support 11 and the top ring 75 is accurately fixed.

If, at this time, the workpiece support 11 and the top ring 75 are positionally displaced with respect to each other, then any one of the guide posts 29 hits the outer circumferential surface of the guide ring 76, and a horizontal force is applied to the workpiece support 11. Since the workpiece support 11 is placed on the horizontally movable sliding mechanism 61, the workpiece support 11 automatically moves under such a horizontal force in a horizontal direction to cause the guide ring 76 to be positioned inside all of the guide posts 29 while the guide ring 76 is in sliding contact with the guide posts 29, thus automatically compensating for such a positional misalignment between the workpiece support 11 and the top ring 75.

When positioning the top ring 75 and the workpiece support 11, if the positions thereof are offset from each other, the outer circumferential surface of the guide ring 76 contacts any one of the conical tip ends of the guide posts 29. However, since the workpiece support 11 is placed on the sliding mechanism 61, the workpiece support 11 is moved horizontally in a horizontal plane including X- and Y axes by the sliding mechanism 61 to allow the guide ring 76 to be positioned inside the guide posts 29. Accordingly, the workpiece support 11 and the top ring 75 are automatically smoothly positioned accurately relatively to each other. The high hardness of the outer circumferential surface of the guide ring 76 prevents the guide ring 76 from being damaged by engagement with the guide posts 29.

Inasmuch as the workpiece support 11 and the top ring 75 are automatically positioned with respect to each other, no previous strict positional adjustment is required between the workpiece support 11 and the top ring 75.

Figure 7:
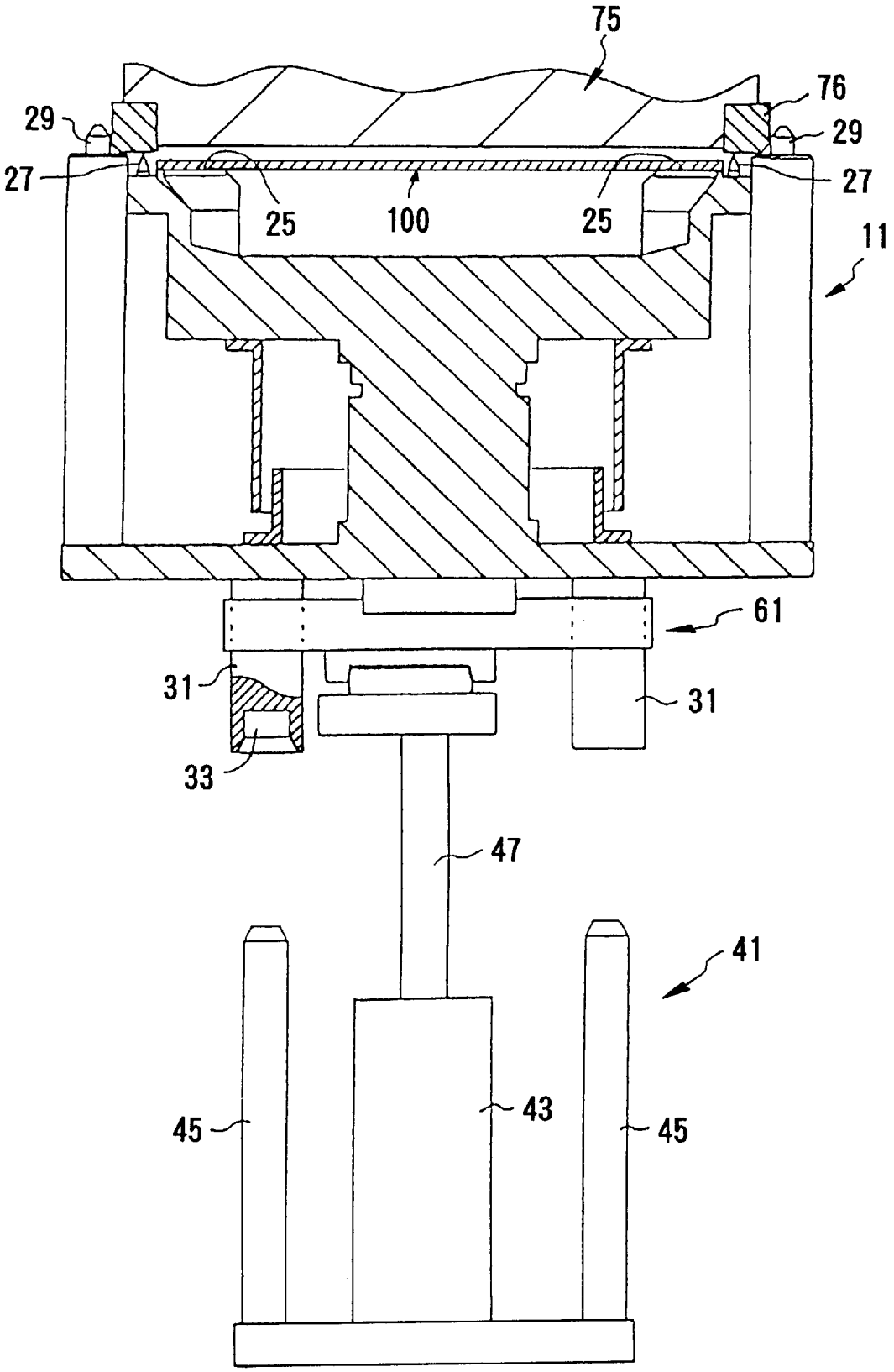
FIG. 7 is a vertical cross-sectional view of the pusher which is in operation according to an embodiment of the present invention.

After the workpiece support 11 and the top ring 75 are positioned with respect to each other, the semiconductor wafer 100 is removed from the top ring 75 by ejecting fluid such as air from the top ring 75. At this time, the semiconductor wafer 100 is accurately positioned on the workpiece support 11 by the guide pins 27, as shown in FIG. 7.

Then, the vertical actuating mechanism 43 is operated to lower the workpiece support 11 to the position shown in FIG. 3. As shown in FIG. 3, the tapered upper ends of the positioning pillars 45 engage the respective recesses 33 in the legs 31, whereupon the workpiece support 11 is accurately positioned with respect to the actuating unit 41. This combination of the tapered upper ends of the positioning pillars 45 and the respective recesses 33 in the legs 31 serves as a positioning mechanism. Since the semiconductor wafer 100 is accurately positioned on the workpiece support 11 by the guide pins 27, the semiconductor wafer 100 can reliably and accurately be transferred from the pusher 10 to the hand of the workpiece conveying robot 91 (see FIG. 1) without a transfer error. When transferring the semiconductor wafer 100, the hand of the robot 91 is inserted into a space between the wafer holders 23 below the semiconductor wafer 100 on the arcuate ridges 25.

The semiconductor wafer 100 can be transferred from the hand of the workpiece conveying robot 91 to the top ring 75 by reversal of the above operations.

In the illustrated embodiment, the four guide posts 29 of the workpiece support 11 are employed as a positioning mechanism for positioning the workpiece support 11 and the top ring 75 with respect to each other. However, three guide posts 29, or a combination of holes and pins which can be fitted in the holes, or any of various similar mechanisms, may be employed as such a positioning mechanism.

As described above, the present invention offers the following advantages:

1) When a workpiece such as a semiconductor wafer is transferred between the pusher and the top ring, the pusher and the top ring can be accurately positioned relatively to each other, and hence transfer accuracy is improved and transfer error is prevented.

2) Since the pusher and the top ring are automatically positioned accurately relatively to each other, no previous strict positional adjustment is required between the pusher and the top ring.

Although a certain preferred embodiment of the present invention has been shown and described in detail, it should be understood that various changes and modifications may be made thereto without departing from the scope of the appended claims.

What is claimed is:

1. A polishing apparatus for polishing a surface of a workpiece, said apparatus comprising:

a turntable having a polishing surface;

a top ring for supporting a workpiece to be polished and for pressing the workpiece against said polishing surface; and a pusher located outwardly of said polishing surface for transferring the workpiece between said top ring and said pusher, said pusher comprising:

a workpiece support for supporting the workpiece;

an actuating unit for moving said workpiece support in a vertical direction; and a sliding mechanism movable within a horizontal plane and supporting said workpiece support.

2. An apparatus as claimed in claim 1, wherein said pusher further comprises a first positioning mechanism for positioning said workpiece support and said top ring with respect to each other when the workpiece is transferred between said workpiece support and said top ring.

3. An apparatus as claimed in claim 2, wherein said first positioning mechanism comprises at least one engaging member for engaging a predetermined portion of said top ring when said workpiece support is moved by said actuating unit in said vertical direction toward said top ring.

4. An apparatus as claimed in claim 3, wherein said engaging member comprises a guide post operable to engage an outer circumferential surface of said top ring.

5. An apparatus as claimed in claim 1, wherein said workpiece support includes at least one workpiece holder having a location to receive the workpiece, and plural guide pins for guiding the workpiece toward said location when the workpiece is transferred from said top ring.

6. An apparatus as claimed in claim 1, wherein said sliding mechanism is positioned between said workpiece support and said actuating unit and comprises a pair of sliding assemblies disposed perpendicular to each other and each including a rail and a slider movable along said rail.

7. An apparatus as claimed in claim 1, further comprising a second positioning mechanism for positioning said workpiece support with respect to said actuating unit when said workpiece support is located at a lowermost position thereof.

8. An apparatus as claimed in claim 1, wherein said pusher is operable to transfer the workpiece to be polished to said top ring and to receive the workpiece after it has been polished from said top ring.

9. An apparatus as claimed in claim 8, further comprising a reversing unit for reversing the workpiece to be polished before supply thereof to said pusher.

10. An apparatus as claimed in claim 9, further comprising another reversing unit for reversing the polished workpiece after removal thereof from said pusher.

11. An apparatus as claimed in claim 8, further comprising a reversing unit for reversing the polished workpiece after removal thereof from said pusher.

12. A polishing apparatus for polishing a surface of a workpiece, said apparatus comprising:

a turntable having a polishing surface;

a top ring for supporting a workpiece to be polished and for pressing the workpiece against said polishing surface; and a pusher located outwardly of said polishing surface for transferring the workpiece between said top ring and said pusher, said pusher comprising:

a workpiece support for supporting the workpiece, said workpiece support including a workpiece holder having a location to receive the workpiece, and a guide member for guiding the workpiece toward said location when the workpiece is transferred from said top ring;

an actuating unit for moving said workpiece support in a vertical direction; and a first positioning mechanism for positioning said workpiece support and said top ring with respect to each other when the workpiece is transferred between said workpiece support and said top ring, said first positioning mechanism comprising at least one engaging member for engaging a predetermined portion of said top ring when said workpiece support is moved by said actuating unit in said vertical direction toward said top ring, said at least one engaging member being fixedly positioned on said workpiece support.

13. An apparatus as claimed in claim 12, wherein said engaging member comprises a guide post operable to engage an outer circumferential surface of said top ring.

14. An apparatus as claimed in claim 12, wherein said guide member comprises a plurality of guide pins.

15. An apparatus as claimed in claim 12, further comprising a sliding mechanism movable within a horizontal plane and supporting said workpiece support.

16. An apparatus as claimed in claim 15, wherein said sliding mechanism is positioned between said workpiece support and said actuating unit and comprises a pair of sliding assemblies disposed perpendicular to each other and each including a rail and a slider movable along said rail.

17. An apparatus as claimed in claim 12, further comprising a second positioning mechanism for positioning said workpiece support with respect to said actuating unit when said workpiece support is located at a lowermost position thereof.

18. An apparatus as claimed in claim 12, wherein said pusher is operable to transfer the workpiece to be polished to said top ring and to receive the workpiece after it has been polished from said top ring.

19. An apparatus as claimed in claim 18, further comprising a reversing unit for reversing the workpiece to be polished before supply thereof to said pusher.

20. An apparatus as claimed in claim 19, further comprising another reversing unit for reversing the polished workpiece after removal thereof from said pusher.

21. An apparatus as claimed in claim 18, further comprising a reversing unit for reversing the polished workpiece after removal thereof from said pusher.

22. A polishing apparatus for polishing a surface of a workpiece, said apparatus comprising:

a workpiece conveying robot, a turntable having a polishing surface;

a top ring for supporting a workpiece to be polished and for pressing the workpiece against said polishing surface; and a pusher located outwardly of said polishing surface for transferring the workpiece between said top ring and said pusher, said pusher comprising:

a workpiece support for supporting the workpiece, said workpiece support including a workpiece holder having a location to receive the workpiece, and a guide member for guiding the workpiece toward said location when the workpiece is transferred from said top ring and when the workpiece is transferred from a hand of said workpiece conveying robot to said workpiece holder, said guide member comprising a plurality of guide pins; and an actuating unit for moving said workpiece support in a vertical direction.

23. An apparatus as claimed in claim 22, further comprising a sliding mechanism movable within a horizontal plane and supporting said workpiece support.

24. An apparatus as claimed in claim 23, wherein said sliding mechanism is positioned between said workpiece support and said actuating unit and comprises a pair of sliding assemblies disposed perpendicular to each other and each including a rail and a slider movable along said rail.

25. An apparatus as claimed in claim 22, further comprising a positioning mechanism for positioning said workpiece support with respect to said actuating unit when said workpiece support is located at a lowermost position thereof.

26. An apparatus as claimed in claim 22, wherein said pusher is operable to transfer the workpiece to be polished to said top ring and to receive the workpiece after it has been polished from said top ring.

27. An apparatus as claimed in claim 26, further comprising a reversing unit for reversing the workpiece to be polished before supply thereof to said pusher.

28. An apparatus as claimed in claim 27, further comprising another reversing unit for reversing the polished workpiece after removal thereof from said pusher.

29. An apparatus as claimed in claim 26, further comprising a reversing unit for reversing the polished workpiece after removal thereof from said pusher.

30. A polishing apparatus as claimed in claim 22, wherein said guide member is horizontally fixedly provided on said workpiece holder.

* * * * *